US007871497B2

(12) United States Patent
Westerkamp

(10) Patent No.: US 7,871,497 B2
(45) Date of Patent: Jan. 18, 2011

(54) PAPER MACHINE COVERING

(75) Inventor: Arved Westerkamp, Dettingen (DE)

(73) Assignee: Voith Patent GmbH, Heidenheim (DE)

( * ) Notice: Subject to any disclaimer, the term of this patent is extended or adjusted under 35 U.S.C. 154(b) by 1133 days.

(21) Appl. No.: 11/526,405

(22) Filed: Sep. 25, 2006

(65) Prior Publication Data

US 2007/0111011 A1 May 17, 2007

(30) Foreign Application Priority Data

Sep. 30, 2005 (DE) ..... 10 2005 046 902

(51) Int. Cl.
*D21F 7/12* (2006.01)
*D21F 2/00* (2006.01)
*B32B 27/40* (2006.01)

(52) U.S. Cl. ..... 162/358.2; 162/306; 162/902; 428/423.3; 442/394

(58) Field of Classification Search ..... 162/348, 162/358.2, 306, 900–904, 358.4; 156/308.2, 156/331.4; 428/423.1, 423.3, 425.6; 442/58, 442/180, 394

See application file for complete search history.

(56) References Cited

U.S. PATENT DOCUMENTS

| | | | | |
|---|---|---|---|---|
| 4,758,460 | A * | 7/1988 | Spicer et al. | 428/159 |
| 4,762,751 | A * | 8/1988 | Girgis et al. | 428/378 |
| 5,609,936 | A | 3/1997 | Kohler et al. | 428/107 |
| 5,759,927 | A * | 6/1998 | Meeker | 442/334 |
| 2005/0170720 | A1 * | 8/2005 | Christiansen et al. | 442/1 |

FOREIGN PATENT DOCUMENTS

| | | |
|---|---|---|
| DE | 4139634 | 6/1993 |

* cited by examiner

*Primary Examiner*—Eric Hug
(74) *Attorney, Agent, or Firm*—Taylor IP, P.C.

(57) ABSTRACT

A covering for a machine for treating a material web, in particular a fibrous web, has a multilayer construction with at least two layers formed respectively by at least one polyurethane film, between which there lies a layer made of a reinforcement fabric whose mesh widths are selected such that the two adjacent layers of polyurethane film touch each other in the meshes. This covering can be used advantageously in particular as a transfer belt or a dryer fabric.

53 Claims, 1 Drawing Sheet

PAPER MACHINE COVERING

BACKGROUND OF THE INVENTION

1. Field of the Invention

This invention relates to a covering for a machine for treating a material web, in particular a fibrous web. Also, it relates to special uses of this covering.

2. Description of the Related Art

To date, coatings of transfer belts for use in paper machines are produced mainly by way of knife coating methods. In this case polymers are applied and knife-coated two-dimensionally onto a textile carrier which in most cases is based on a press felt. A film solution in which polyurethane films are endlessly welded in the transverse direction and then wound around a carrier has already been proposed. The carrier in question is a conventional felt-based fabric which is combined with fleece layers and a so-called "Arcus" thread layer. However, this proposal has turned out to be inclined toward delamination, as the carrier layer onto which the films are laminated becomes detached in conditions of high shear stress such as can arise in particular in a press nip. Delamination then occurs as the result. One of the reasons for this is that the applied polyurethane films are unable, because of their small thickness, to create a genuine form-fit connection with the threads or fleeces lying underneath or to enter into a bond with each other. Furthermore, the process provided to date is relatively difficult to reproduce on account of its complexity, as the result of which the process results vary from one manufactured belt to the next.

What is needed is an improved covering of the type initially referred to. The covering can be manufactured in an easier manner. Furthermore, the functionality of the covering can be enhanced in the case of a transfer belt for example, in particular for critical applications such as a double nip for example, in a so-called center belt application for example.

SUMMARY OF THE INVENTION

The present invention provides a covering that has a multilayer construction with at least two layers formed respectively by at least one polyurethane film, between which there lies a layer made of a reinforcement fabric whose mesh widths are selected such that the two adjacent layers of polyurethane film touch each other in the meshes.

By virtue of this construction, the covering can be manufactured in an easier manner. Furthermore, by accordingly varying the condition and construction of the various layers for example, it is possible, if required, to accordingly enhance the respectively desired functionality of the covering. Thus it is also possible to configure the covering in particular for critical applications for example. Hence the covering, accordingly configured, can also be used in a press arrangement with a double nip for example; hence it can also be used in a so-called center belt arrangement for example.

According to an embodiment of the present invention, the two layers of polyurethane film adjacent a respective reinforcement fabric are joined together in the meshes of the reinforcement fabric. The mesh widths of the reinforcement fabric are dimensioned such that the two adjacent layers of polyurethane film enter into a bond with each other in the meshes.

The reinforcement fabric includes a glass fabric. A corresponding glass fiber mesh structure is characterized in particular in that it is very light and stable.

It is also an advantage in particular for the reinforcement fabric to include a so-called leno fabric.

Advantageously the covering has a multilayer construction with more than two layers formed respectively by at least one polyurethane film, whereby respectively one layer of a reinforcement fabric is arranged between respectively two layers of polyurethane film at least in some sections as viewed in the thickness direction.

The mesh widths of a respective layer of reinforcement fabric are again selected such that the two adjacent layers of polyurethane film touch each other in the meshes and again enter into a bond with each other therein or are ultimately joined together in said meshes.

In certain cases it can be an advantage for at least two successive layers of polyurethane film, without a reinforcement fabric in between, to be provided in some sections as viewed in the thickness direction.

The respective reinforcement fabric again includes a glass fabric.

According to another embodiment of the present invention, the thickness of a respective polyurethane film lies in a range from around 50 to around 500 μm. Preferably the thickness of a respective layer of polyurethane film lies in this range from around 50 to around 500 μm.

For certain applications, in addition to the reinforcement fabric, at least one textile reinforcement layer which is arranged between successive polyurethane films can be provided.

In this case the at least one textile reinforcement layer includes: a fabric or a plaiting or a knitting or a wound thread assemblage or a fleece.

If the reinforcement fabric is formed by a glass fiber fabric, then a reinforcement layer can be formed by a fabric of polymer threads for example, such as PA or PE for example. Alternatively or in addition to this, a reinforcement layer can be formed by a fleece made of glass fibers. Furthermore, it is possible in addition or alternatively to this for a reinforcement layer to be formed by a thread plaiting made of glass fibers or carbon fibers or aramide fibers for example.

Advantageously, a respective reinforcement fabric includes weft threads and warp threads whose density is selected such that the resulting meshes are big enough for the two adjacent layers of polyurethane film laminated thereon to touch each other in the meshes and to enter into a bond with each other therein.

Advantageously the various layers are wound on to form a layer construction.

In this case the layers can be wound in particularly diagonally or obliquely to the running direction of the covering.

In this case the layers can overlap at least partly, whereby it is expedient for the thickness of a respective layer in this case to be equal to or smaller than 300 μm.

In particular in the case of thicker layers, said layers can also come together at the edge in addition to at their surface. In this case the thickness of a respective layer is equal to or greater than 300 μm.

According to another embodiment of the present invention, the various layers are of different condition or construction at least in part.

In this case in particular the various layers of polyurethane film can be of different condition or construction at least in part.

In many cases it is an advantage in particular for the various layers to differ in respect of their functionality at least in part. In this case in particular the various layers of polyurethane film can differ in respect of their functionality at least in part.

According to another embodiment of the present invention, the layer on the side of the material web is of a condition such that it permits as good a detachment of the material web as possible.

Alternatively or in addition to this, the layer on the side of the material web can, expediently, also be of a condition such that it has as small an inclination toward soiling as possible.

It is also an advantage in particular for the layer on the running side, meaning the machine side, to include as resistant or wear-resisting a polyurethane cover film as possible. The layer on the running side can, expediently, also include a profiled or three-dimensionally structured polyurethane cover film. With an accordingly resistant and, for example, also a profiled cover film on the running side, the result is a corresponding resistance to wear.

The cover layer on the running side formed from one or more films can have a thickness of up to 1.5 mm in this case.

It is also an advantage in particular for the layer on the side of the material web to include a dirt-repelling polyurethane cover film.

According to another embodiment of the present invention, the covering includes at least one hydrophobic layer. Alternatively or in addition to this, it can advantageously include at least one hydrophilic layer as well.

In certain cases it is also an advantage for the various layers of reinforcement fabric to be of a different condition and construction at least in part.

The various layers of reinforcement fabric differ from each other in respect of their thread density at least in part. Alternatively or in addition to this, they can also differ from each other in respect of their thread fineness at least in part.

Provision is made for at least one layer of reinforcement fabric, such as glass fabric, with a thickness smaller than 0.5 mm.

The multilayer construction of the covering can be on the whole permeable or on the whole impermeable. The same applies also for the individual layers.

It is expedient for at least one outer layer to be formed by a layer of polyurethane film, whereby both outer layers are formed respectively by such a layer of polyurethane film.

It is also an advantage in particular for the covering to include on the whole more than two layers, in particular more than four layers, preferably more than six layers, in particular more than eight layers, preferably more than ten layers and in particular around twelve layers.

According to another embodiment of the present invention, the covering is constructed as a transfer belt. In this case this transfer belt has a thickness smaller than 4 mm, in particular a thickness smaller than 3 mm.

However, alternatively, the covering can also be constructed in particular as a dryer fabric. In this case the covering is constructed to be permeable.

Hence the covering of the invention can be used advantageously as a transfer belt or a dryer fabric.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawing, wherein.

Corresponding reference characters indicate corresponding parts throughout the several views. The exemplification set out herein illustrates one embodiment of the invention, and such exemplification is not to be construed as limiting the scope of the invention in any manner.

DETAILED DESCRIPTION OF THE PREFERRED EMBODIMENT

Figure 1:
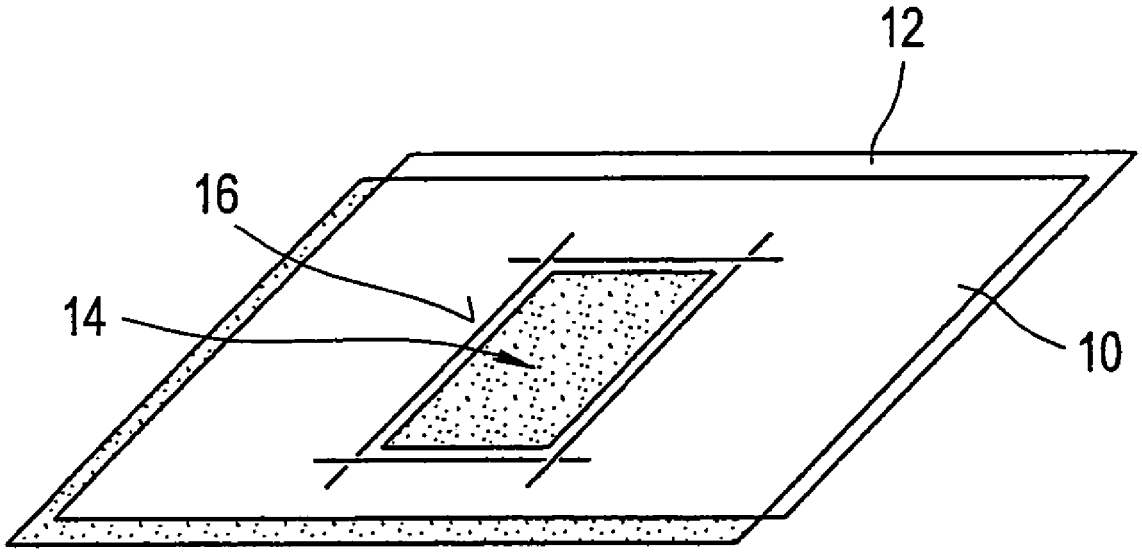
FIG. 1 is a schematic, partial representation of the multiplayer construction of a covering according to the present invention.

Referring now to the drawing, there is shown two laminated on polyurethane films 10, 12 which touch each other and enter into a bond with each other in the meshes 14 of a layer of reinforcement fabric 16 lying in between. The reinforcement fabric 16 includes a glass fabric.

Hence the covering in question has a multilayer construction with at least two layers formed respectively by at least one polyurethane film, between which there lies a layer made of a reinforcement fabric whose mesh widths are selected such that the two adjacent layers of polyurethane film touch each other in the meshes and the two layers of polyurethane film are bonded together therein.

The covering can be constructed in particular as a transfer belt or as a dryer fabric.

For the respective lamination of the covering using polyurethane films and glass fabrics, polyurethane films with a thickness in a range from around 50 to around 500 μm for example are positioned in layers one above the other. Inserted between the layers of polyurethane film are glass fabrics, which in terms of their weft and warp thread density are calculated such that the resulting meshes are large enough for the laminated on films to touch each other in the meshes and enter into a bond with each other.

The layers can be wound in particular diagonally. In this case they can overlap at least in part provided they are thin enough, meaning that they have a thickness equal to or smaller than 300 μm for example. Thicker layers can also be joined together at the edge in addition to at their surface.

Advantageously the individual layers can differ from each other in terms of their functionality.

For example, the paper-side layer expediently guarantees a corresponding release of the paper web and at the same time displays as small an inclination toward soiling as possible. On the running side or machine side it is expedient to apply an accordingly resistant and, for example, also a profiled cover film in order to obtain a corresponding resistance to wear.

FIG. 1 shows the touching of two films in the mesh opening by way of example.

The multilayer construction of the covering results from a combination of polyurethane films and glass fabrics distributed over several layers.

To prevent the formation of air cushions and to bring about the controlled discharge of water which may collect on the running side, the polyurethane film is three-dimensionally structured on the running side or machine side.

The finish and/or construction of the polyurethane films can be varied according to their use within the structure or the multilayer construction of the covering. A wear-resisting polyurethane film for example is possible on the running side and/or a dirt-repelling polyurethane film on the paper side. Not only individual polyurethane films but also the entire multilayer construction of the covering can be hydrophobic or hydrophilic for example.

Alternatively or in addition to this, the construction of the reinforcement fabric can also be varied. For example, various thread densities and/or various thread finenesses are possible. In this case a glass fabric is used. The respective reinforcement fabric has a thickness smaller than 0.5 mm.

The corresponding glass fiber mesh structure is characterized in particular in that it is light and stable. The glass fiber mesh structure can also be constructed in particular as a so-called leno fabric.

The different material components are wound up into a layer construction. In this case, as already mentioned, said material components can overlap each other partly on the side or come together in a butt joint.

The multilayer construction or the structure of the covering can be permeable or impermeable.

The covering can be used to particular advantage in particular as a transfer belt or a dryer fabric. In the event of the covering being constructed as a transfer belt, the belt has a thickness smaller than 3 mm.

In the following, two preferred superstructures of the covering, suitable in particular for a transfer belt, with twelve (Table 1) or fifteen (Table 2) layers arranged one above the other are presented in table form. Listed in the left column are the various layers starting with the paper-touching layer. The middle column lists the material from which the respective layer is made. The right column lists the thickness of the respective layer:

TABLE 1

| | | |
|---|---|---|
| Layer 1 (paper-touching layer) | Polyurethane | 0.30 mm |
| Layer 2 | Glass fabric | 0.20 mm |
| Layer 3 | Polyurethane | 0.20 mm |
| Layer 4 | Polyurethane | 0.25 mm |
| Layer 5 | Glass fabric | 0.20 mm |
| Layer 6 | Polyurethane | 0.15 mm |
| Layer 7 | Glass fabric | 0.25 mm |
| Layer 8 | Polyurethane | 0.25 mm |
| Layer 9 | Glass fabric | 0.25 mm |
| Layer 10 | Polyurethane | 0.20 mm |
| Layer 11 | Glass fabric | 0.25 mm |
| Layer 12 (running side layer) | Polyurethane | 0.50 mm |

TABLE 2

| | | |
|---|---|---|
| Layer 1 (paper-touching layer) | Polyurethane | 0.30 mm |
| Layer 2 | Glass fabric | 0.20 mm |
| Layer 3 | Polyurethane | 0.20 mm |
| Layer 4 | Polyurethane | 0.25 mm |
| Layer 5 | Glass fabric | 0.20 mm |
| Layer 6 | Polyurethane | 0.15 mm |
| Layer 7 | Glass fiber fleece | 0.5 mm |
| Layer 8 | Polyurethane | 0.15 mm |
| Layer 9 | Glass fabric | 0.25 mm |
| Layer 10 | Polyurethane | 0.15 mm |
| Layer 11 | PA fabric | 0.25 mm |
| Layer 12 | Polyurethane | 0.15 mm |
| Layer 13 | Glass fabric | 0.25 mm |
| Layer 14 | Polyurethane | 0.15 mm |
| Layer 15 | Glass fabric | 0.25 mm |
| Layer 16 (running side layer) | Polyurethane | 0.50 mm |

The glass fabric can be constructed as a conventional fabric or as a leno fabric for example. In the case of the conventional fabric, simple or complex weaves are possible. In addition, the covering according to the invention can include one or more textile reinforcement layers which are formed from a polymer material for example.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claim.

List of reference numerals

| | |
|---|---|
| 10 | Polyurethane film |
| 12 | Polyurethane film |
| 14 | Mesh |
| 16 | Reinforcement fabric |

What is claimed is:

1. A covering for a machine for treating a fibrous web, said covering comprising a plurality of layers, at least two of said plurality of layers comprised of at least one polyurethane film, at least one of said plurality of layers being a reinforcement layer comprised of a reinforcement fabric positioned between adjacent said at least two layers, said reinforcement fabric including a mesh, said mesh having a width configured such that said at least two layers of polyurethane film touch each other in said mesh, said plurality of layers including on the whole more than two layers of polyurethane film which are coupled with one another.

2. The covering according to claim 1, wherein said at least two layers of polyurethane film are bonded together in said mesh of said reinforcement fabric.

3. The covering according to claim 1, wherein said reinforcement fabric comprises a glass fabric.

4. The covering according to claim 1, wherein said reinforcement fabric comprises at least one of a leno fabric and a conventional fabric.

5. The covering according to claim 1, wherein the covering includes a plurality of sections, and more than two layers of said plurality of layers comprised of at least one polyurethane film, in a thickness direction of the covering one said layer of reinforcement fabric is arranged between two said layers of polyurethane film at least in some of said plurality of sections.

6. The covering according to claim 5, wherein said layer of reinforcement fabric includes a mesh, said mesh having a width configured such that adjacent said two layers of polyurethane film touch each other in said mesh.

7. The covering according to claim 6, wherein said layers of polyurethane film adjacent said layer of reinforcement fabric are bonded together in said mesh.

8. The covering according to claim 5, wherein in said thickness direction of the covering at least two successive said layers of polyurethane film are without said reinforcement fabric between said at least two successive said layers of polyurethane film at least in some said sections of the covering.

9. The covering according to claim 5, wherein said reinforcement fabric comprises a glass fabric.

10. The covering according to claim 1, wherein a thickness of each said polyurethane film lies in a range from around 50 to around 500 μm.

11. The covering according to claim 1, wherein a thickness of each said layer of polyurethane film lies in a range from around 50 to around 500 μm.

12. The covering according to claim 1, further comprising at least one reinforcement layer comprised of a textile reinforcement layer.

13. The covering according to claim 12, wherein said at least one reinforcement layer is arranged between successive said polyurethane films.

14. The covering according to claim 12, wherein said at least one textile reinforcement layer comprises at least one of a fabric, a plaiting, a knitting, a wound thread assemblage, and a fleece.

15. The covering according to claim 12, wherein said at least one textile reinforcement layer comprises at least one of a polymer, a carbon, and an aramide.

16. The covering according to claim 1, wherein said reinforcement fabric comprises weft threads and warp threads, said reinforcement fabric having a density configured such that said at least two layers of polyurethane film touch each other in said mesh.

17. The covering according to claim 16, wherein said at least two layers of polyurethane film bond with each other therein.

18. The covering according to claim 1, wherein said plurality of layers are wound on to form a layer construction.

19. The covering according to claim 18, wherein said plurality of layers are wound one of diagonally and obliquely to a running direction of the covering.

20. The covering according to claim 19, wherein said plurality of layers overlap each other at least in part.

21. The covering according to claim 20, wherein a thickness of each said plurality of layers is equal to or smaller than 300 μm.

22. The covering according to claim 19, wherein said plurality of layers have at least one edge and at least one surface, said plurality of layers come together at said at least one edge and at said at least one surface.

23. The covering according to claim 22, wherein a thickness of each said plurality of layers is equal to or greater than 300 μm.

24. The covering according to claim 1, wherein said plurality of layers are of a different condition and construction at least in part.

25. The covering according to claim 24, wherein said layers of polyurethane film are of a different condition and construction at least in part.

26. The covering according to claim 24, wherein each said plurality of layers differs at least in part in respect of a functionality of each said plurality of layers.

27. The covering according to claim 26, wherein each said layers of polyurethane film differs at least in part in respect of a functionality of each said layers of polyurethane.

28. The covering according to claim 24, wherein the fibrous web has a side, at least one layer of said plurality of layers is on said side of the fibrous web, wherein said at least one layer on said side of the fibrous web being configured for permitting as good a detachment of the fibrous web as possible.

29. The covering according to claim 28, wherein said at least one layer on said side of the fibrous web being configured for permitting as small an inclination toward soiling as possible.

30. The covering according to claim 28, wherein said at least one layer on said side of the fibrous web comprises a dirt-repelling polyurethane cover film.

31. The covering according to claim 24, wherein said plurality of layers has a running side, at least one layer of said plurality of layers is on said running side, said at least one layer on said running side comprises a polyurethane cover film.

32. The covering according to claim 31, wherein said at least one layer on said running side comprises one of a profiled polyurethane cover film and a three-dimensionally structured polyurethane cover film.

33. The covering according to claim 31, wherein said at least one layer on said running side has a thickness of up to 1.5 mm.

34. The covering according to claim 1, wherein said plurality of layers comprises at least one hydrophobic layer.

35. The covering according to claim 1, wherein said plurality of layers comprises at least one hydrophilic layer.

36. The covering according to claim 1, wherein each said layer of reinforcement fabric is one of a different condition and a different construction at least in part.

37. The covering according to claim 36, wherein each said layer of reinforcement differs in respect of a thread density at least in part.

38. The covering according to claim 36, wherein each said layer of reinforcement fabric differs in respect of a thread fineness at least in part.

39. The covering according to claim 1, wherein at least one said layer of reinforcement fabric has a thickness smaller than 0.5 mm.

40. The covering according to claim 39, wherein at least one said layer of reinforcement fabric comprises a glass fabric.

41. The covering according to claim 1, wherein said plurality of layers is on the whole permeable.

42. The covering according to claim 1, wherein said plurality of layers is on the whole impermeable.

43. The covering according to claim 1, wherein said plurality of layers includes at least one outer layer comprising a layer of polyurethane film.

44. The covering according to claim 43, wherein said plurality of layers includes two outer layers comprising at least one layer of polyurethane film.

45. The covering according to claim 1, said plurality of layers comprises on the whole more than four layers.

46. The covering according to claim 1, said plurality of layers comprises on the whole more than six layers.

47. The covering according to claim 1, said plurality of layers comprises on the whole more than eight layers.

48. The covering according to claim 1, said plurality of layers comprises on the whole more than ten layers.

49. The covering according to claim 1, said plurality of layers comprises on the whole around twelve layers.

50. The covering according to claim 1, wherein said plurality of layers is a transfer belt.

51. The covering according to claim 50, said transfer belt has a thickness smaller than 4 mm.

52. The covering according to claim 50, said transfer belt has a thickness smaller than 3 mm.

53. The covering according to claim 1, said plurality of layers is a dryer fabric.

* * * * *